United States Patent [19]

Lorscheidt

[11] 4,139,311

[45] Feb. 13, 1979

[54] DISPENSING CARTRIDGE HAVING AN IMPROVED AUTOMATIC FILLER STICK POSITIONING MECHANISM

[76] Inventor: Willy Lorscheidt, Schulstrasse 12, D-5026 Dansweiler, Fed. Rep. of Germany

[21] Appl. No.: 791,494

[22] Filed: Apr. 27, 1977

[30] Foreign Application Priority Data

May 3, 1976 [DE] Fed. Rep. of Germany ..... 2619441

[51] Int. Cl.[2] ..... B43K 21/02

[52] U.S. Cl. ..... 401/55; 401/98; 401/102; 215/341; 277/212 F

[58] Field of Search ..... 401/61, 98, 60, 59, 401/102, 55, 49, 108, 176–178; 220/304; 277/212 F; 215/341, 346; 222/389, 388

[56] References Cited

U.S. PATENT DOCUMENTS

| | | | |
|---|---|---|---|
| 1,685,413 | 9/1928 | Ashley | 401/177 |
| 2,027,656 | 1/1936 | Tassie | 401/187 |
| 2,079,320 | 5/1937 | Kalber | 215/341 |
| 2,149,147 | 2/1939 | Peterson et al. | 277/212 F |
| 2,573,452 | 10/1951 | Klippert | 401/55 |
| 2,626,847 | 1/1953 | Brown | 401/55X |
| 2,903,278 | 9/1959 | Wormser | 277/212 F X |
| 3,027,874 | 4/1962 | Bross | 401/176 X |
| 3,066,836 | 12/1962 | Trumbull | 222/389 X |
| 3,217,936 | 11/1965 | Abplanalp | 222/389 X |
| 3,897,874 | 8/1975 | Coons | 220/304 X |

*Primary Examiner*—Clifford D. Crowder
*Attorney, Agent, or Firm*—Meyer, Tilberry & Body

[57] ABSTRACT

A cartridge for dispensing a filler stick wherein the stick is advanced automatically out of one end of the cartridge by the removal of the cap. The stick is supported on a piston slidable in the cartridge and vented at the bottom of the cartridge to the atmosphere and the cap and cartridge have a slidable seal such that removal of the cartridge creates a vacuum within the cap to enable the air pressure on the piston to force the stick out of the cartridge.

12 Claims, 5 Drawing Figures

29
30
31
11
26
25
27
28
32
24
23
20
22
21
10
12
13
14
15
16
17
18
19
x
y

DISPENSING CARTRIDGE HAVING AN IMPROVED AUTOMATIC FILLER STICK POSITIONING MECHANISM

This invention pertains to the art of dispensing cartridges for a filler stick such as a deodorant stick, adhesive stick or the like and more particularly to a cartridge wherein removal of the cap causes the filler stick to be advanced out of the cartridge.

It has been conventional in the past to provide a container for filler sticks such as deodorant sticks, adhesive sticks or cosmetic sticks with a base carrying the filler stick which is advanced and retracted within the container by means of a sleeve rotatable on the cartridge and which engages a screw spindle on the base carrying the filler stick. To use the stick, the cover had to first be removed and then the stick had to be advanced into the working position by rotation of the sleeve. There were thus two separate manual operations required to bring the filler stick into the working position.

The same was also true where the base carrying the filler stick could be advanced within the cartridge by means of inserting a finger into the base of the container and pressing the base until the filler stick projected sufficiently from the top of the container to be used.

The present invention provides a cartridge for such filler sticks which overcomes the above problems and which enables the filler stick to be advanced from the container by a simple manipulation and which cartridge is simple to manufacture at relatively low cost.

In accordance with the invention, a cartridge includes a cylindrical container with a piston in the lower end which carries the filler stick, the lower end of the piston being vented to the atmosphere in combination with a cup shaped cover cap slidably mounted on the upper end of the container in sealed relationship therewith such that when the cap is removed, a partial vacuum is generated within the cap resulting in a pressure differential between the top of the filler stick and the bottom of the piston which pressure differential moves the piston and advances the filler stick out of the container.

With such an arrangement, removal of the cover cap automatically advances the filler stick into working position such that immediately after the cap is taken off, the filler stick is available for its intended purpose. The automatic advance of the filler stick results from the vacuum created within the cover cap by its removal in combination with the atmospheric pressure on the bottom side of the piston carrying the filler stick. The pressure differential created is sufficient to automatically advance the filler stick.

In order to create a sufficiently great vacuum within the cap when the cover is removed, a circumferential gasket is provided between the outside of the container and the inside of the cover. By appropriately locating the circumferential gasket longitudinally of the cap, the amount that the filler stick is pushed out from the container can be adjusted.

The cartridge in accordance with the invention, contains only a few and relatively simple parts and can be produced at a relatively low cost. The cartridge and the various parts are preferably made of plastic.

In order to prevent an overpressure within the cap when it is replaced, the circumferential seal is constructed in such a way that it has a kind of valve function which means that the seal is raised from the surface against which it is sealing when an overpressure occurs to thus relieve the overpressure. Thus in accordance with the invention, a circumferential gasket is mounted in an annular slot on the cartridge although it is possible that the gasket can be mounted on the inside of the cup shaped cover cap.

In accordance with the invention, the container has on its outer surface a connecting portion for retaining the cover cap in position. Such connecting portion can be a threaded section which coacts with corresponding threads on the cover cap. Alternatively, the container can have a slightly conical surface which wedgingly engages with a correspondingly tapered or conical surface on the inside of the cap. In the first case, the cap was screwed on and off of the container. In the second case, the cap is simply pushed on and off of the container.

The location of the circumferential gasket can be above or below this connecting portion whether it be a threaded section or the conical shape.

Preferably, the groove for the circumferential gasket is arranged an axial distance above the connecting portion on the container which is about equal to the dimension by which it is desired that the filler stick will project from the container when it is in its working position. More preferably, however, the circumferential gasket is located below the connecting section whether it be threaded or conical since, in this instance, injuries to the circumferential gasket by the threads of the cover cap when it is removed or returned cannot occur.

Preferably, the cover cap has a thread-free portion below the connecting portion, the axial length of which is at least about equal to the axial length of the connecting portion on the container. In this way, the seal is maintained between the container and the cap during the entire time that the cap is being unscrewed and thus the vacuum in the interior of the cap remains effective to, in effect, draw the filler stick upwardly and out of the container.

According to a preferred embodiment of the invention, the circumferential gasket has an elastic sealing lip or the like which is pressed by vacuum within the cover cap against the sealing surface, which lip moves away from the sealing surface whenever an overpressure exists within the cap. In this way the gasket has a form of valve function since it prevents the formation of excessive pressures within the cap when the cover cap is screwed on and thus makes certain that the required pressure differential will be available for pushing out the filler stick when the cap is next removed.

The sealing gasket in accordance with the invention is in the form of a base ring having a sealing lip extending therefrom and joined to the base ring by means of a flexible link. Thus, preferably the sealing lip is curved on the outside or crescent-shaped and arranged in such a way that it lays with its convex outer surface against the sealing surface on the inside of the cap. Preferably also, the groove has a rectangular shape and the base portion of the gasket is arranged so that its corners sealingly engaged the corners of the groove so as to provide a sealing action between the base of the groove and the gasket.

Particularly when the filler stick contains volatile ingredients and/or have the tendency to shrink in time, the piston supporting the filler stick preferably has spike shaped elastic sealing ribs on the outside in sliding engagement with the inside of the container. In accordance with the invention, these sealing ribs respectively slant at an acute angle to the axis of the piston in such a way that the ribs engage in the wall with a greater friction when the piston moves downwardly then when it moves upwardly. In this way, when the filler has been advanced to the working position and the pressure is placed thereon, it does not unintentionally retract. On the other hand, when the piston is being advanced to the filler stick extended position, the friction is relatively light so that the pressure differential can easily advance the piston and the filler stick to the extended or working position.

The invention may take physical form in certain parts and arrangements of parts, preferred embodiments of which will be described in detail in this specification and illustrated in the accompanying drawings which form a part hereof and wherein.

Figures 1, 2, 3:
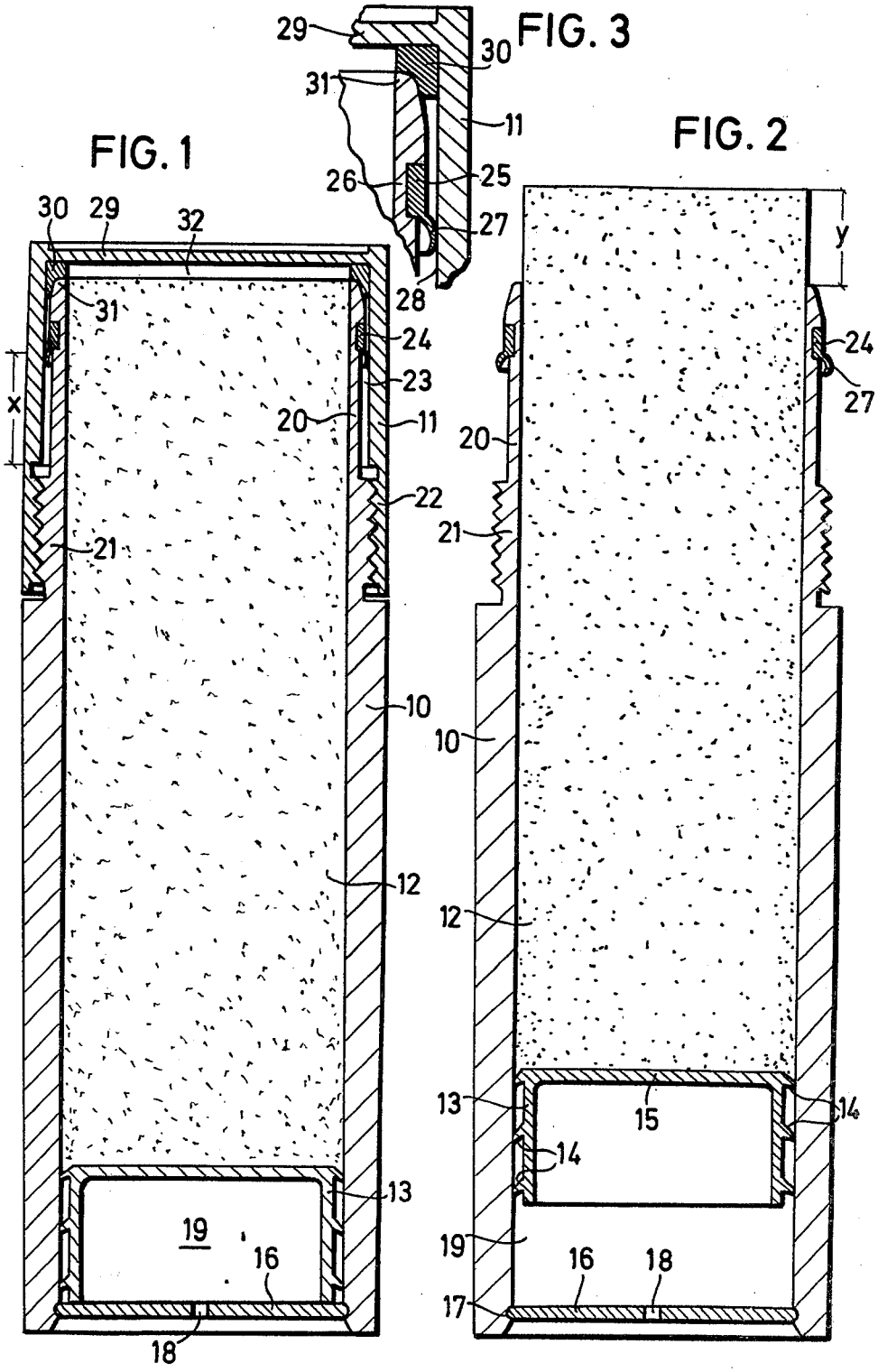
FIG. 1 is a cross sectional view of a dispensing cartridge with the cover cap screwed on and the filler stick completely retracted illustrating a preferred embodiment of the invention.
FIG. 2 is a view similar to FIG. 1 with the cover cap removed and the filler stick advanced into the working position.
FIG. 3 is an enlarged cross sectional view of the sealing gasket shown in FIGS. 1 and 2; and, FIG. 4 is a cross sectional view of a dispensing cartridge illustrating an alternative embodiment of the invention.

Referring now to the drawings wherein the showings are for the purposes of illustrating preferred embodiments of the invention only and not for the purposes of limiting same, the dispenser shown in FIGS. 1–3 consist of a cylindrical container or sleeve 10 which is closable at its top by means of a cup shaped cover cap 11. The sleeve 10 and the cover cap 11 are preferably made of plastic. The sleeve 10 receives a filler stick 12, for instance a deodorant or adhesive stick or a stick of some other effective substance for cosmetic or other purposes. Such sticks are generally manufactured by casting and hardening the filler material within the sleeve 10.

The filler stick 12 is supported on its bottom side by a piston which is appropriately also made of plastic and cup shaped with a downwardly facing concavity. The outer cylindrical surface of the piston 13 is provided with a plurality, in this case three, of sealing and guiding ribs 14 which generally taper to a point and are in tightly sealed relationship with the inner cylindrical wall of the sleeve 10. These ribs are, as shown, so molded onto the outside of the piston shell that they are slanted downwardly relative to the axis of the piston and the sleeve at an acute angle in such a way that the piston encounters when it is moving out or upwardly only relatively little wall friction, whereas when the piston is moving inwardly or downwardly there is a substantially greater wall friction. In this way, the filler stick 12 after being advanced into the working position as shown in FIG. 2 is not unintentionally pushed back into the sleeve 10 when light pressures are exerted on the exposed end of the filler stick 12 while it is being used.

The piston 13 preferably has a smooth upper or outer surface on its bottom 15 so that the filler stick can be practically completely used up with no great residual quantities of the filler stick material remaining on the piston 13.

The lower end of the sleeve 10 is preferably closed by a bottom 16 consisting of a plastic disc forced into a groove 17 formed on the inner surface of the sleeve. The disc 16 has a venting opening 18 which makes sure that the space 19 beneath the piston 13 is always at atmosphere pressure.

The sleeve 10 on its outer or upper end has a neck 20 of reduced diameter and immediately below the neck 20 has an external screw thread 21. The cover cap 11 is provided with an internal thread 22 such that it can be screwed onto the threaded section 21 of the sleeve 10. With this arrangement, when the cap is in position an annular gap 23 exists above the thread 22. This annular gap 23 is sealed by means of a circumferential gasket 24 made of plastic or any other elastic material. As shown in FIG. 3, the gasket 24 consists of a base sealing ring body 25 generally rectangular in cross section. This base 25 fits into an annular slot 26 adjacent the upper end of the necked down portion 20. The gasket 24 further consists of a generally crescent shaped elastic sealing lip 27 extending from the lower outer corner of the base 25, the outer surface of which lip is in sealing engagement with the inner cylindrical surface of the cap 11. It is to be noted that this lip is flexible and that pressures above the lip will tend to force the sealing lip away from the inner wall of the cylindrical cap while pressures on the lower side of the lip 27 will tend to force it into greater sealing pressure with the inner wall of the cap 11.

The cap 11 has a top 29 and a sealing ring 30 is provided inside of the cap at the intersection of the top 29 and the side walls of the cap which when the cap is in closed position, presses tightly against the upper outer corner 31 of the upper end of the sleeve 10.

When the cover cap 11 is removed from the sleeve 10, a vacuum develops in the space 32 within the cover cap between its bottom 29 and the filler stick 12. The space 32 is sealed on the one hand by means of the gasket 24 and on the other hand by means of the filler stick 12 and the piston 13, with its sealing and guiding ribs 14. This seal remains until the cover cap 11 is completely screwed off of sleeve 10. When the vacuum is created in the space 32, the elastic sealing lip 27 is tightly pressed against the inner wall 28 of the cap 11 so that a good sealing action results. Since the under side of the filler stick 12 and of the piston 13 is exposed to normal atmospheric pressure due to the vent 18, a pressure differential is created between the top and bottom of the filler stick 12 and the filler stick 12 is pushed upwardly out of the sleeve 10 into the working position shown in FIG. 2. The distance Y by which the filler stick 12 is advanced out of the sleeve 10 is equal to the distance X which corresponds to the distance of the gasket 24 above the threaded section 21, i.e. the distance on the inner surface of the cap below the gasket 24 which is smooth and unbroken by the threads. Thus, by varying the distance X in the course of manufacture, the amount that the filler stick will be advanced out of the sleeve can be controlled.

When the cover cap 11 is replaced onto the sleeve 10, the filler stick 12 is automatically pushed back into the sleeve 10 by engagement with the bottom 29 of the cap. It will be appreciated that the volume of the space 32 inside of the cap 11 is reduced when the cap 11 is screwed on so that a pressure above atmospheric will result in this space 32. This excessive pressure tends to force the sealing lip 27 of the gasket 24 away from the inner wall 28 or the cap 11 so that the excess pressure is reduced or relieved. This circumferential gasket with its elastic sealing lip 27 has therefor the function of a valve which seals the space 32 only when the cover cap is unscrewed but not when the cover cap is screwed on. The filler stick 12 is thus always automatically advanced into the same working position when the cover cap 11 is unscrewed. It is always ready for use immediately upon removal of the cap.

It will be appreciated that the cartridge described consists of only a few simple and inexpensively produced individual parts which can be manufactured at a favorable cost and yet the cartridge always is simply operated.

Figure 4:
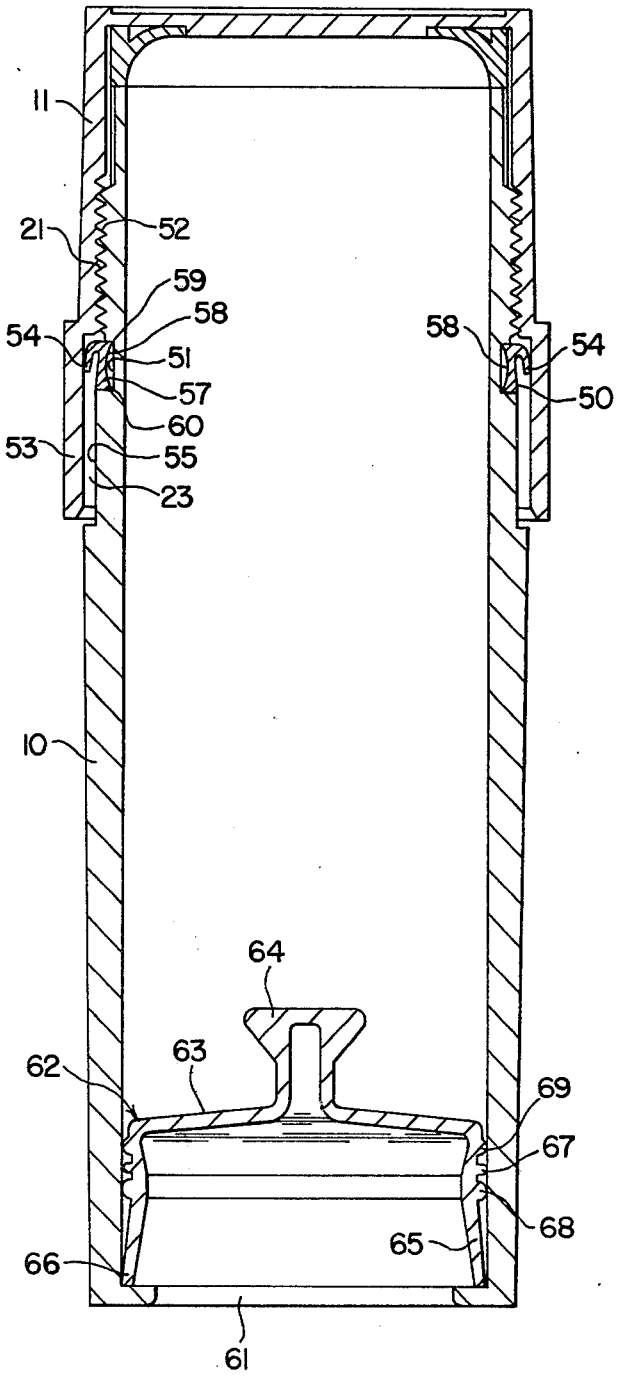

FIG. 4 shows an alternative embodiment of the pushup cartridge according to the invention like parts to the embodiment of FIG. 1 being given the same reference number. In FIG. 4, a circumferential gasket 50 is disposed in an annular groove or slot 51 positioned immediately below the threaded section 21, onto which section a threaded section 52 of cover cap 11 can be screwed. The cover cap 11 has below its threaded section 52 an elongated flange-like cylindrical shell extension 53 of a larger internal diameter than the threads 21, the inside of which shell is thread-free and smooth. The gasket 50 has a downwardly extending lip 54 which tightly and sealingly engages the inside of this shell. The sealing lip 54 preferably has an arcuate outer surface which engages this shell extension inner surface. The axial length of the shell extension 53 is so dimensioned that the sealing between the sealing lip 54 and the cylindrical inner surface of the shell elongation 53 is maintained at least until the cover cap 11 is completely unscrewed from the sleeve 10.

It will be noted that the sleeve 10 has a portion of reduced diameter below the sealing gasket 50 which results in a space 23 between the outer surface of the sleeve 10 and the inner surface of the portion 53 of the cap 11. The sealing lip 54 of the gasket 50 is preferably molded so that its upper edge is integral with gasket 50 and extends downwardly therefrom and in spaced relationship thereto. In this way, the sealing lip 54 can act as a valve to relieve pressures developing above the lip 54 but would be pressed into tight sealing engagement with the inner surface of the shell extension 53 when pressures above the sealing lip 54 are reduced as the cap 11 is unscrewed.

The base 57 of the gasket 50 has a concave recess 58 on its inner or bottom surface to provide corners 59 and 60 which engage the corners of the slot 51 to provide a sealing action at this point.

The sleeve 10 at the bottom is open as at 61. A piston 62 is guided within the sleeve and has an upwardly extending projection 64 on its bottom surface 63 which projection 64 is shaped like a button or mushroom to bring about reliable anchoring of the filler stick onto the piston. The piston 62 is in the shape of an inverted cup with the walls of the cup tapering downwardly and outwardly relative to the axis of the piston such that its lower edge 66 sealingly and elastically engages the cylindrical inner wall of the sleeve 10. The outer surface of the piston 62 is also provided with a sealing lip 67 which also tightly and sealingly engages against the cylindrical inner surface of the sleeve 10. The piston 10 also has a pair of cylindrical guide surfaces 68, 69 adjacent its upper end and the sealing lip 67 is positioned therebetween so that the piston is both guided for axial movement in the shell 10 and also sealed. The sealing lip 65 slopes outwardly and downwardly such that the friction between the lip 65 and the inner wall of the sleeve 10 is less when the piston is moving in or upwardly than when it is moving out or downwardly.

In FIG. 4, the piston is shown wherein the bottom 63 is closed or imperforate. Such a piston is suitable for filling the inside of the sleeve 10 from the top where a flowable filler material is poured into the sleeve and subsequently hardens by drying or cooling.

Figure 5:
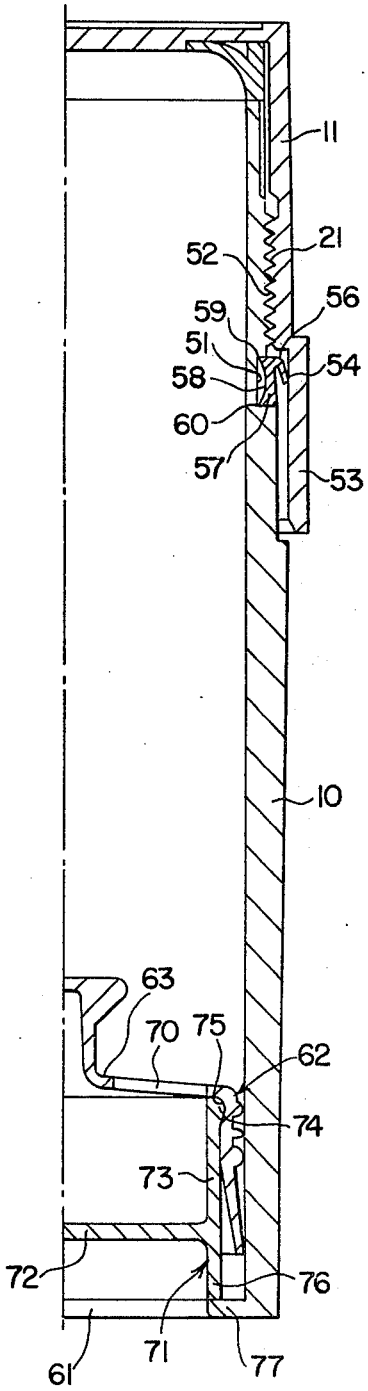
FIG. 5 is a cross-sectional view of a dispensing cartridge illustrating a second alternative embodiment of the invention.

FIG. 5 shows the right side of a second alternative piston wherein the bottom of the piston has an opening 70 so that the sleeve 10 can be filled with a flowable material from the bottom. In such a case, however, a closure member 71 is inserted into the lower end of the piston 62 which closure member has a horizontal bottom 72 and a cylindrical shell 73, the upper front edge of which forms a circumferential flange 74 which fits into a peripheral recess 75 in the transition area between the side wall of the piston and the piston bottom 63. The bottom 72 of this closure member seals the interior of the piston at the bottom. The closure member 71 has under each bottom 72 a cylindrical flange 76 which engages an inwardly extending flange 77 on the bottom end of the sleeve 10.

Normally, a liquid filler material is poured into the sleeve 10 from the top, in which operation, the filling material can flow through the perforations 70 into the interior of the piston which is sealed off at the bottom by the closure member 71. After termination of the filling operation, the cover cap 11 is screwed on and the entire cartridge is turned upside down. The filling material then flows back through the opening 70 and into the interior of the sleeve 10 where it hardens forming the filler stick.

The invention has been described with reference to preferred embodiments. Obviously, modifications and alterations will occur to others upon a reading and understanding of this specification and it is my intention to include all such modifications and alterations insofar that they come within the scope of the appended claims.

Having thus described the invention, I claim:

1. In a push-up dispenser comprised of a sleeve containing a filler stick, a piston slidably arranged in said sleeve and supporting said filler stick, and a cup-shaped cover which fits over the top of said sleeve, said sleeve and said cover having coacting threaded portions, arranged on the outer surface of said sleeve and on the inner surface of said cover, the improvement which comprises:

(a) sealing means located on said sleeve below the threaded portion thereof;

(b) an extension of said cover below its threaded portion forming a threadfree sealing surface for sealing contact with said sealing means, the inner diameter of said sealing surface being greater than the outer diameter of said threaded portion on said sleeve;

(c) the length of said sealing surface on said extension is at least approximately equal to the dimension by which the filler stick is desired to project from the opening of said sleeve in the working position;

(d) said sealing means is comprised of a gasket including a base ring sealingly positioned on said sleeve and a flexible downwardly extending lip in sealing sliding contact with said sealing surface on said cover whereby said lip is pressed against said sealing surface by underpressure in the said cover created by unscrewing said cover and can lift itself from the said sealing surface in the case of overpressure under said cover;

(e) the lower surface of said piston being exposed to atmospheric pressure whereby, when said cover is removed, said pressure on said lower surface of said piston together with said underpressure in said cover will move said piston and filler stick upwardly out of said sleeve to a working position.

2. The dispenser of claim 1 wherein the sleeve has a portion of reduced diameter on the side of said gasket toward the bottom of said sleeve.

3. The dispenser of claim 1 wherein said sealing lip is in the form of a crescent and its convex surface bears against said sealing surface.

4. The dispenser of claim 3 wherein said sealing lip is connected with the base ring of said gasket by means of a flexible joint portion.

5. The dispenser of claim 1 wherein said cover has a sealing ring at the intersection of the top and side walls of said cover which, when the cover is in the closed position, presses tightly against the upper outer cover of said sleeve.

6. The dispenser of claim 1 wherein said piston has at least one sealing means in sliding sealing engagement with the inner cylindrical surface wall of said sleeve.

7. The dispenser of claim 6 wherein said sealing means of said piston is a radially extending elastic sealing rib.

8. The dispenser of claim 7 wherein said sealing rib is slanted downwardly at an acute angle to the axis of the piston in such a way that the piston encounters greater wall friction when it moves downwardly than when it moves upwardly.

9. The dispenser of claim 7 wherein said piston has a plurality of radially extending sealing ribs.

10. The dispenser of claim 1 wherein said piston is in the shape of an inverted cup with the concavity of the cup exposed to the atmospheric pressure, the filler stick being mounted on the base of the cup.

11. The dispenser of claim 1 wherein said piston is in the shape of an inverted cup and the walls of said cup slant obliquely outwardly so that the lower edge thereof sealingly engages the inner wall of the sleeve.

12. The dispenser of claim 11 wherein said piston has at least one radial sealing lip positioned above the lower edge of the cup.

* * * * *